US005386867A

United States Patent [19]

Chen

[11] Patent Number: 5,386,867

[45] Date of Patent: Feb. 7, 1995

[54] VENETIAN BLIND

[75] Inventor: Milton Chen, Taichung, Taiwan, Prov. of China

[73] Assignee: Care Mate International Co., Ltd., Taichung, Taiwan, Prov. of China

[21] Appl. No.: 63,706

[22] Filed: May 20, 1993

[51] Int. Cl.[6] ..... E06B 9/26

[52] U.S. Cl. ..... 160/168.1

[58] Field of Search ..... 160/168.1 R, 173 R, 160/236, 172 R, 176.1 R, 177 R, 178.1 R, 166.1 R

[56] References Cited

U.S. PATENT DOCUMENTS

| | | | |
|---|---|---|---|
| 2,200,349 | 5/1940 | Walker | 160/168.1 R X |
| 2,374,591 | 4/1945 | Dunn | 160/168.1 R X |
| 2,440,769 | 5/1948 | Hackett | 160/168.1 R |
| 2,620,865 | 12/1952 | Isserstedt | 160/173 R |
| 2,690,215 | 9/1954 | Croxen | 160/173 R |
| 2,785,744 | 3/1957 | Berni | 160/173 R |
| 3,189,081 | 6/1965 | Lorentzen et al. | 160/173 R |

*Primary Examiner*—David M. Purol

*Attorney, Agent, or Firm*—Browdy and Neimark

[57] ABSTRACT

A Venetian blind including a head rail, a tilting device, two or more tilt cords, a bottom rail, a predetermined number of draw cords, a cord pulley retainer, and a plurality of slats fastened to the tilt cords such that the slats are spaced equidistantly and parallel to one another and that the slats can be adjusted at any angle to regulate the light by the tilting device. Each of the slats is provided with two or more through holes located on the same side of a center line of the slat. The through holes of one slat are therefore obscured by the lower edge of another slat located thereover at the time when the slats are in an upright position to keep out the light.

3 Claims, 3 Drawing Sheets

VENETIAN BLIND

FIELD OF THE INVENTION

The present invention relates generally to a Venetian blind, and more particularly to an improved Ventian blind that keeps out the light more effectively.

BACKGROUND OF THE INVENTION

Referring to FIGS. 1–4, a typical Venetian blind 10 of the prior art is shown to comprise a head rail 11, a tilting device 13, three tilt cords 14, a bottom rail, a plurality of slats 16, two draw cords 17, and a cord pulley retainer 18.

The head rail 11 is fastened securely to a wall or a window frame. The tilting device 13 is mounted pivotally in the head rail 11. Each of the three tilt cords 14 has one end fastened to the tilting device 13 and another end that is suspended. Each tilt cord 14 is composed of two slings 141 parallel to each other. Located between the two slings 141 are a plurality of connection lines 142 which are equidistantly spaced. The bottom rail 15 is disposed at the bottom ends of the tilt cords 14 and is parallel to the head rail 11. The slats 16 are disposed respectively between the two slings 141 of the tilt cord 14 and are supported by the connection lines 142 such that the slats 16 are suspended equidistantly. Each of the slats 16 is provided with two through holes 161 corresponding in location to the tilt cords 14. The through holes 161 of the adjacent slats 16 are corresponding in location to one another. The tilting device 13 is used to cause the slings 141 to move upwards or downwards so as to regulate the position of the slats 16 in order to keep out the light. Each of the two draw cords 17 has one end that is fastened to the bottom rail 15 and another end that passes through the through holes 161 of the slats 16 before emerging via the head rail 11. The draw cords 17 are used to raise or lower the bottom rail 15 so as to draw up or lower the slats 16. The cord pulley retainer 18 is disposed in one side of the head rail 11 for retaining and locating the draw cords 17.

The through holes 161 of the slats 16 are oval in shape and situated on a center line 162 of the slats 16, as shown in FIG. 4. As a result, the slats 16 are not interfered by the draw cords 17 at the time when the slats 16 are set together at an angle to regulate the light. However, when the slats 16 are adjusted to be in an upright position to keep out the light, as shown in FIG. 3, the through holes 161 of the Venetian blind 19 are so exposed that they allow the light to pass therethrough and that they can be improperly used as peep holes.

SUMMARY OF THE INVENTION

It is therefore the primary objective of the present invention to provide a Venetian blind with improved structures capable of overcoming the shortcomings of the prior art Venetian blind described above.

In keeping the principles of the present invention, the foregoing objective of the present invention is attained by an improved Venetian blind, which comprises a head rail, a tilting device disposed in the head rail, two or more tilt cords fastened respectively at one end thereof with the tilting device, a bottom rail, a plurality of slats fastened to the tilt cords such that they are equidistantly spaced and parallel to one another and that they can be adjusted at any angle to regulate the light by means of the tilting device, a predetermined number of draw cords fastened respectively at one end thereof with the bottom rail and having respectively another end emerging from the head rail for raising and lowering the slats, and a cord pulley retainer disposed in the head rail for retaining and locating the draw cords. The slats are provided with through holes located on the same side of the center line of the slats such that the through holes of one slat are obscured by the lower edge of another slat located thereover at the time when the slats are positioned uprightly.

DETAILED DESCRIPTION OF THE INVENTION

Figure 3:
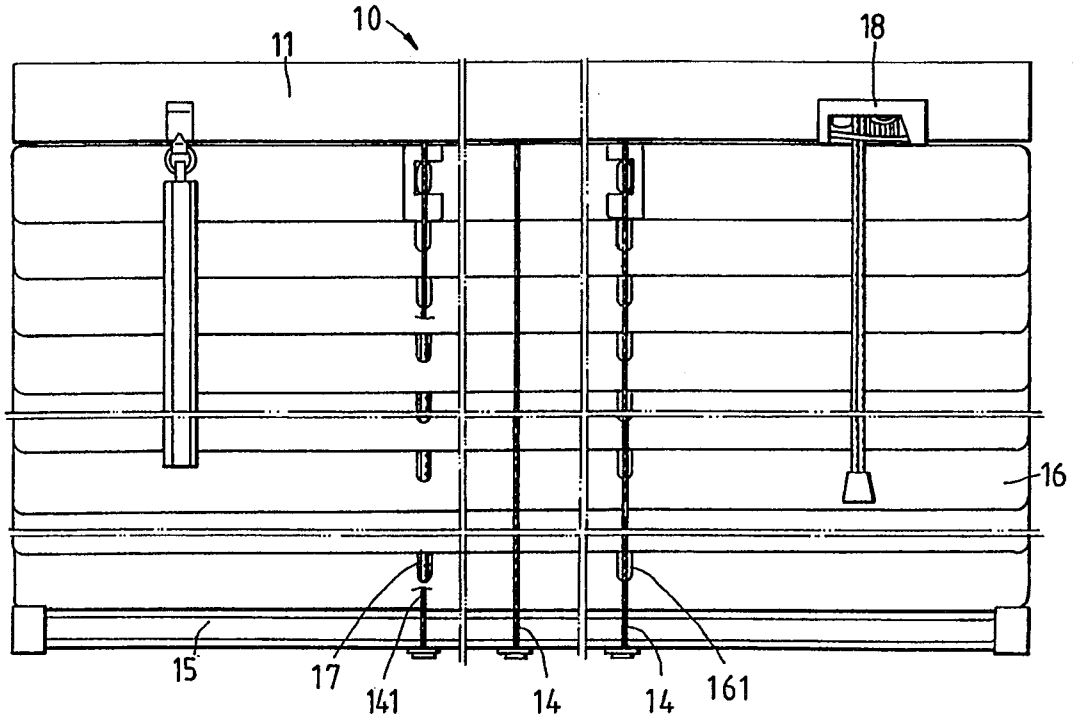
FIG. 3 PRIOR ART
FIG. 3 is a side elevational view of the prior art Venetian blind of FIG.
Figure 4:
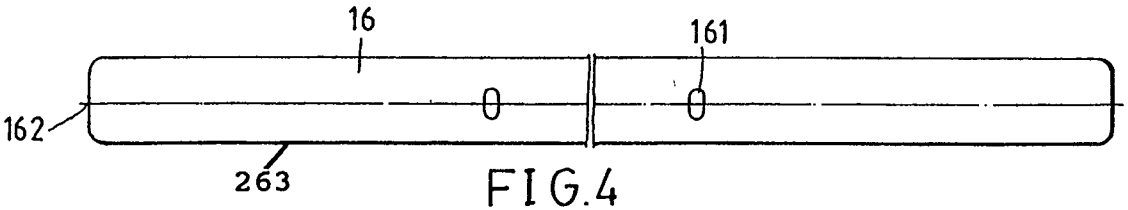
FIG. 4 PRIOR ART
FIG. 4 is a top plan view of the prior art Venetian blind.
Figure 2:
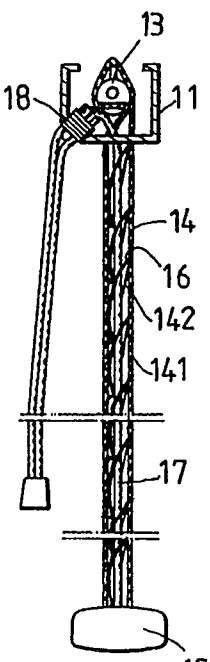
FIG. 2 PRIOR ART
FIG. 2 is a schematic view showing that the slats of the prior art Venetian blind of FIG. 1 are in an upright position.
Figure 1:
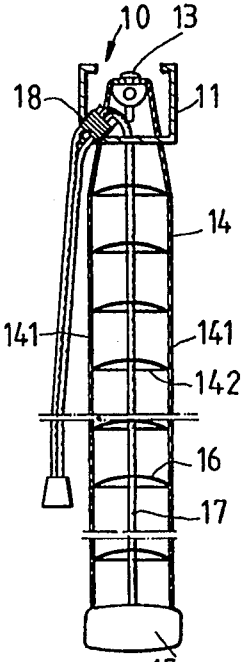
FIG. 1 PRIOR ART
FIG. 1 is a schematic view of a prior art Venetian blind, showing that the slats are in a horizontal position.

Referring to FIGS. 5–8, a Venetian blind 20 of the first preferred embodiment of the present invention is shown comprising: a head rail 21; a tilting device 23; three tilt cords 24, each of which comprises two slings 241 and a plurality of connection lines 242; a bottom rail 25; a plurality of slats 26, each of which has two through holes 261; two draw cords 27; and a cord pulley retainer 28.

Figure 7:
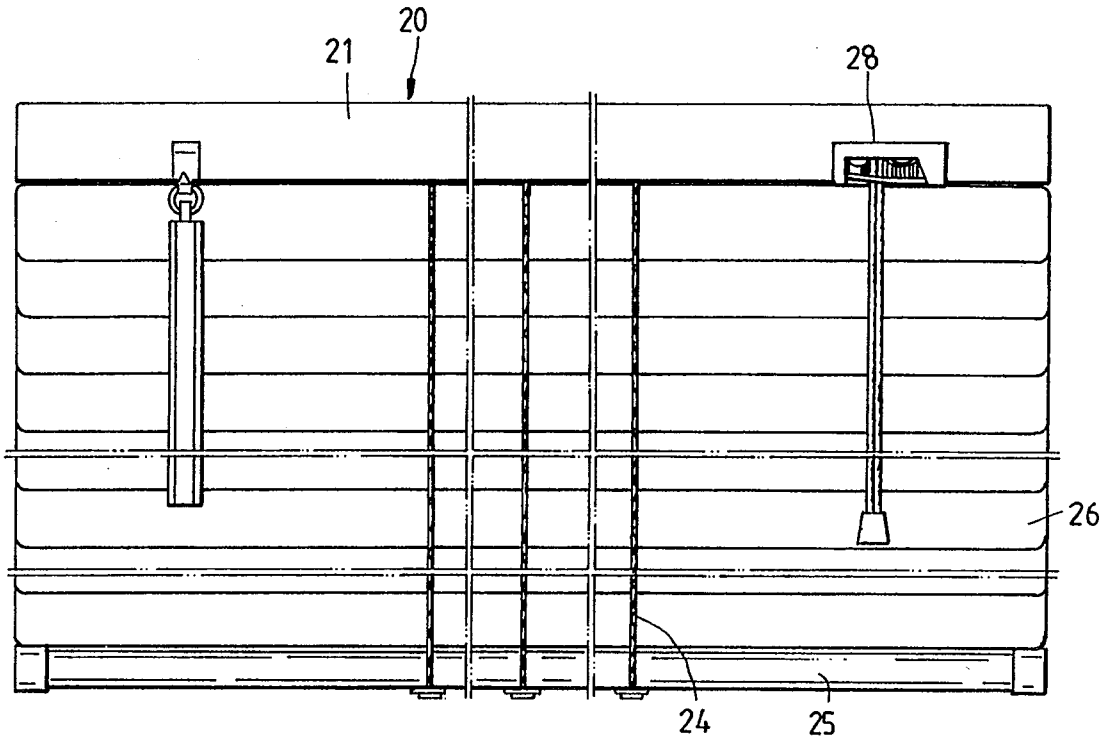
FIG. 7 is a side elevational view of the first preferred embodiment as shown in FIG. 6.
Figure 8:
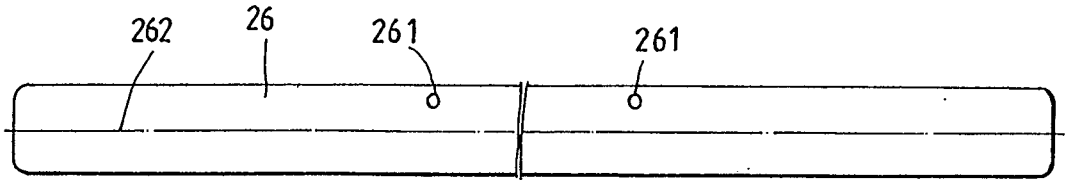
FIG. 8 shows a top plan view of the first preferred embodiment of the present invention.
Figure 6:
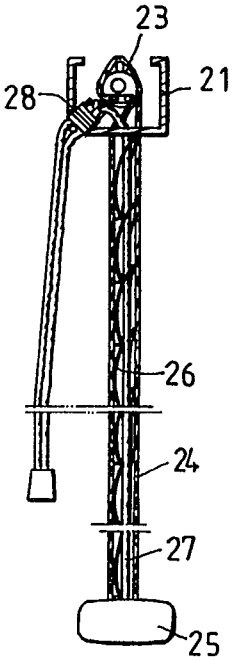
FIG. 6 is a schematic view showing that the slats of the first preferred embodiment of the present invention are in an upright position.
Figure 5:
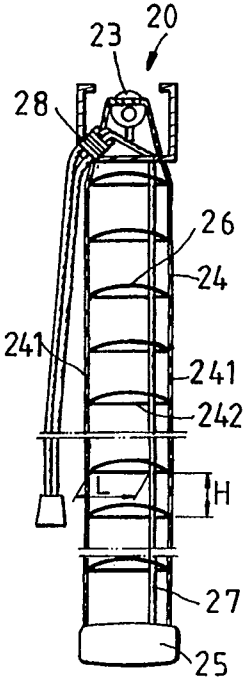
FIG. 5 is a schematic view showing that the slats of a first preferred embodiment of the present invention are in a horizontal position.

The Venetian blind 20 of the present invention is characterized in that the two through holes 261 of each of the slats 26 are located on the same side of a center line 262 of the slat 26, as shown in FIG. 8. The through holes 261 are circular or oval in shape, with the diameter of the hole being greater than the diameter of the draw cord 27. As shown in FIG. 5, a distance H between the two connection lines 242 is smaller than a distance L between the through hole 261 of the slat 26 and the edge 263 of the slat. As a result, when the slats are in an upright position, as shown in FIGS. 6 and 7, the lower edge of an upper slat 26 obscures the through holes 261 of a lower slat 26. Therefore, the Venetian blind 20 of the present invention can keep out the light completely when the slats 26 are in an upright position. In addition, the through holes 261 of the slats 26 can not be improperly used as peep holes at the time when the slats 26 are in an upright position.

Figure 9:
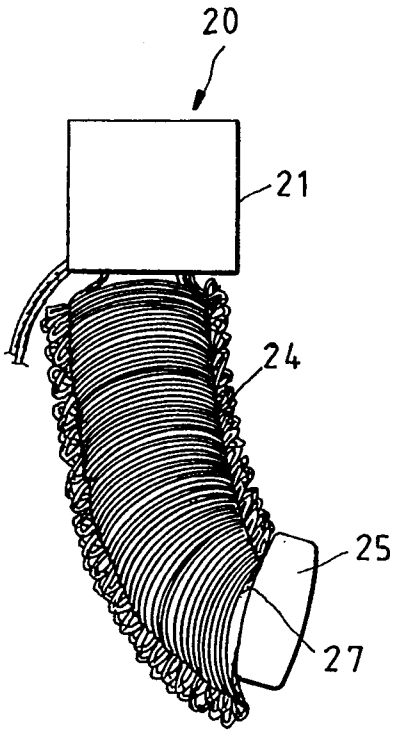
FIG. 9 is a schematic view showing that the first preferred embodiment of the present invention is drawn up.

As shown in FIG. 9, the blind 20 of the present invention is drawn up and is slightly curved as a whole. This is caused by the draw cords 27 of the blind 20, which are located toward one side. The curved body of the Venetian blind 20, as shown in FIG. 9, is a shortcoming from an esthetic viewpoint.

Figure 11:
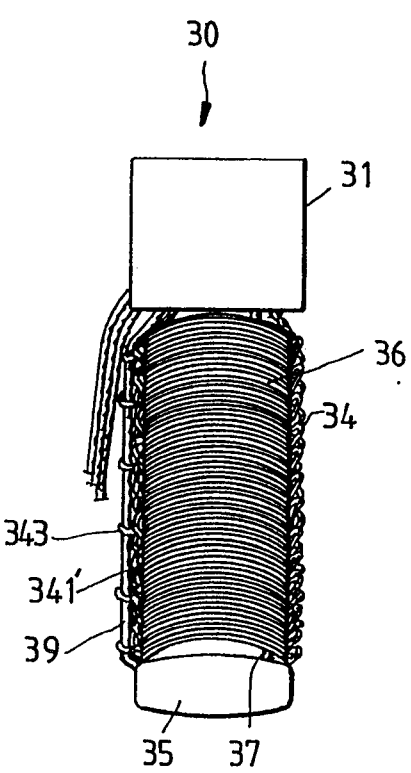
FIG. 11 is a schematic view showing that the second preferred embodiment of the present invention is drawn up.
Figure 10:
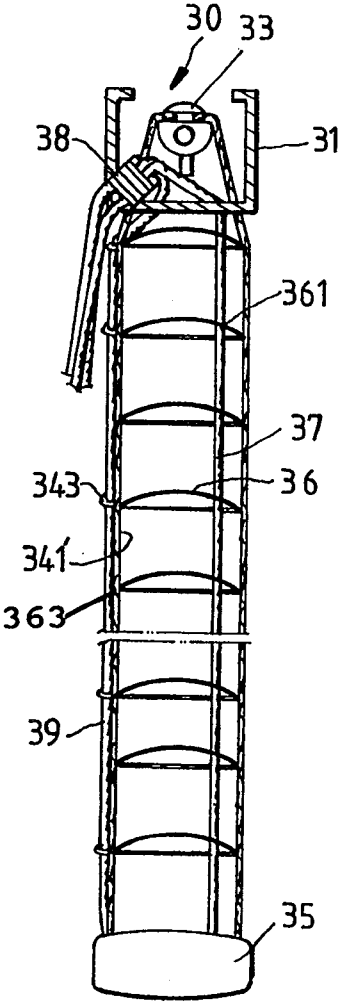
FIG. 10 shows a schematic view of a second preferred embodiment of the present invention.

The shortcoming of the Venetian blind 20 of the first preferred embodiment of the present invention may be overcome by a Venetian blind 30 of the second preferred embodiment of the present invention, which is shown in FIGS. 10 and 11. The blind 30 comprises a head rail 31, a tilting device 33, three tilt cords 34, a bottom rail 35, a plurality of slats 36, two draw cords 37, and a cord pulley retainer 38. The structures and the shapes of the components of the blind 30 are similar to those of the blind 20, with the difference being that the blind 30 comprises a predetermined number of rope rings 343 arranged at a predetermined distance from a sling 341' located at a farther side from the through hole 361 at edge 363 of the slat 36, and that the blind 30 comprises an auxiliary draw cord 39 having one end that is fastened to the bottom rail 35 and having another end that emerges from the cord pulley retainer 38 via the rope rings 343 and the head rail 31. As a result, when the blind 30 is drawn up together, the auxiliary draw cord 39 holds securely one side of the bottom rail 35, with another side of the bottom rail 35 being held securely by the two draw cords 37. The bottom rail 35 is therefore aligned properly, as shown in FIG. 11.

What is claimed is:

1. A Venetian blind, comprising:

a head rail;

a tilting device mounted pivotally in said head rail;

two or more tilt cords, each of which has one end that is fastened to said tilting device and another end that is suspended, and each of said tilt cords comprising two slings parallel to each other and having therebetween a plurality of equidistantly spaced connection lines;

a bottom rail fastened to a bottom end of each of said tilt cords and parallel to said head rail;

a plurality of slats, each of which is arranged between said two slings of said tilt cords and braced by said connection lines, said each of said slats having two or more through holes, said through holes of adjacent slats being being aligned when said adjacent slats are arranged between said two slings, said slats being adjustably mounted in such a manner that said slats can be shifted from a horizontal position to an upright position by means of said tilting device capable of regulating an upward movement and a downward movement of said slings;

a plurality of draw cords corresponding in number to said through holes of said each of said slats, with each of said draw cords having one end that is fastened to said bottom rail and having another end that emerges from said head rail from said through holes of said adjacent slats; and a cord pulley retainer mounted in one side of said head rail for retaining and locating said draw cords;

wherein said through holes of said each of said slats are located on the same side of a center line of said each of said slats; and wherein a distance between said connection lines is smaller than a distance between said through holes and a farthest edge of said slats relative to said through holes, wherein said through holes of a slat are obscured by a lower edge of another slat located over said slat when said slats are in an upright position.

2. The Venetian blind according to claim 1 further comprising one or more auxiliary draw cords having one end that is fastened to said bottom rail and having another end that emerges from said cord pulley retainer from said head rail, said auxiliary draw cords being arranged along with said draw cords on both sides of said slats.

3. The Venetian blind according to claim 1 further comprising a predetermined number of rope rings located at said farthest edge of said slats at a predetermined distance along one of said slings and auxiliary draw cords having one end that is fastened to said bottom rail emerging from said cord pulley retainer after passing through said head rail and said rope rings.

* * * * *